US006223727B1

(12) United States Patent
Tahara et al.

(10) Patent No.: US 6,223,727 B1
(45) Date of Patent: May 1, 2001

(54) SEAL MEMBER MOUNTING STRUCTURE IN ELECTROMAGNETIC FUEL INJECTION VALVE

(75) Inventors: Toshihiro Tahara, Sendai; Manabu Shoji, Iwanuma, both of (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/511,364

(22) Filed: Feb. 23, 2000

(30) Foreign Application Priority Data

Feb. 26, 1999 (JP) ..... 11-049724

(51) Int. Cl.[7] ..... F02M 33/04
(52) U.S. Cl. ..... 123/470
(58) Field of Search ..... 123/468, 469, 123/470, 472, 456

(56) References Cited

U.S. PATENT DOCUMENTS 4,294,215 * 10/1981 Hans et al. ..... 123/470
5,189,782 * 3/1993 Hickey ..... 123/456
5,752,487 * 5/1998 Harrell et al. ..... 123/470
6,102,007 * 8/2000 Furst ..... 123/469

FOREIGN PATENT DOCUMENTS 5-288130 11/1993 (JP) .

* cited by examiner

*Primary Examiner*—Thomas N. Moulis
(74) *Attorney, Agent, or Firm*—Arent Fox Kintner Plotkin & Kahn, PLLC

(57) ABSTRACT

In an electromagnetic fuel injection valve, a fitting surface of a valve housing, over which a seal positioning ring is fitted, is formed of a diameter smaller than that of an annular sealing surface over which a seal member is fitted. A tapered surface is provided between the fitting surface and the sealing surface, and a resilient projection is formed on the seal positioning ring, so that the projection is in pressure contact with the tapered surface in a state in which the seal positioning ring has been fitted over the fitting surface. Thus, the seal positioning ring can be retained easily and precisely in a regular position on the outer peripheral surface of the valve housing by a reaction force provided by the resilient projection and hence, no post-treatment is required.

5 Claims, 5 Drawing Sheets

$D_1 < D_2 < D_3$ $D_1 < D_2 < D_3$

SEAL MEMBER MOUNTING STRUCTURE IN ELECTROMAGNETIC FUEL INJECTION VALVE

BACKGROUND OF THE INVENTION

1. Field of the Invention

The present invention relates to a seal member mounting structure in an electromagnetic fuel injection valve, and particularly, to an improvement in a seal member mounting structure including a step which is formed on an outer periphery of a valve housing having a valve seat at its front end and which faces a front end of the valve housing, a seal positioning ring made of a synthetic resin, which is mounted on the outer periphery of the valve housing to abut against the step, a cap which is fitted over and locked to an outer periphery of the front end of the valve housing to define an annular seal mounting groove on an outer peripheral surface of the valve housing by cooperation with the seal positioning ring, and an annular seal member which is mounted in the seal mounting groove to come into close contact with an inner peripheral surface of a mounting bore provided in an intake manifold of an engine.

2. Description of the Related Art

Such seal member mounting structure in the electromagnetic fuel injection valve is already known, as disclosed, for example, in Japanese Patent Application Laid-open No.5-288130.

In the conventionally known seal member mounting structure in the electromagnetic fuel injection valve, the seal positioning ring is formed integrally on the valve housing by molding. Therefore, the width of the annular seal mounting groove defined on the outer peripheral surface of the valve housing by the combination of the seal positioning ring and the cap can be stabilized to provide a good sealing function to the seal member mounted in the annular seal mounting groove.

However, when the structure including the seal positioning ring formed integrally on the valve housing by molding is employed, a troublesome post-treatment for removing a flash protruding toward the seal mounting groove is required, which is disadvantageous in cost. Moreover, there is a possibility that the seal mounting groove may be damaged during the post-treatment.

SUMMARY OF THE INVENTION

Accordingly, it is an object of the present invention to provide a seal member mounting structure of the above-described type in an electromagnetic fuel injection valve, wherein a seal positioning ring can be mounted easily and precisely in a regular position on an outer peripheral surface of a valve housing, thus eliminating the post-treatment.

To achieve the above object, according to a first aspect and feature of the present invention, there is provided a seal member mounting structure in an electromagnetic fuel injection valve, comprising a step which is formed on an outer periphery of a valve housing having a valve seat at its front end and which faces a front end of the valve housing, a seal positioning ring made of a synthetic resin, which is mounted on the outer periphery of the valve housing to abut against the step, a cap which is fitted over and locked to an outer periphery of the front end of the valve housing to define an annular seal mounting groove on an outer peripheral surface of the valve housing by cooperation with the seal positioning ring, and an annular seal member which is mounted in the seal mounting groove to come into close contact with an inner peripheral surface of a mounting bore provided in an intake manifold of an engine, wherein the valve housing has a fitting surface over which the seal positioning ring is fitted, the fitting surface being formed of a diameter smaller than that of an annular sealing surface which serves as a bottom surface of the seal mounting groove, and a tapered surface which is connected to a rear edge of the sealing surface and which is decreased in diameter toward the fitting surface, and the seal positioning ring is formed so that the ring is fitted over the fitting surface past a state in which it has been forced onto the sealing surface, the seal positioning ring having a resilient projection formed thereon, the resilient projection being placed in pressure contact with the tapered surface in a state in which the seal positioning ring has been fitted over the fitting surface.

With the first feature, when the seal positioning ring is fitted over the fitting surface past the state in which it has been forced onto the sealing surface, the seal positioning ring is retained reliably in a position to abut against the step by a reaction force generated by the resilient projection of the seal positioning ring coming into pressure contact with the tapered surface. Therefore, when the seal member and the cap are then mounted sequentially on the valve housing, the width of the seal mounting groove between the seal positioning ring and the cap can correctly be maintained constant at all times. Thus, when the electromagnetic fuel injection valve is mounted in the mounting bore in the intake manifold, the amount of seal member deformed by the inner peripheral surface of the mounting bore is constant at all times and hence, the seal member can exhibit a stable sealing function. In addition, it is unnecessary to carry out a post-treatment such as the removal of a flash, which can contribute to a reduction in manufacture cost.

According to a second aspect and feature of the present invention, in addition to the first feature, the seal positioning ring is provided with an annular lightening recess which opens into one end surface thereof.

With the second feature, the weight of the seal positioning ring can be reduced by the lightening recess, and the resiliency of an inner peripheral wall of the seal positioning ring can be regulated, thereby enabling the seal positioning ring to pass easily through the state in which the seal positioning ring has been forced onto the sealing surface.

According to a third aspect and feature of the present invention, in addition to the second feature, the resilient projection is formed integrally at a front end of an inner peripheral wall of the seal positioning ring, which is surrounded by the lightening recess.

With the third feature, the shape of the seal positioning ring is simplified by the integral formation of the resilient projection with the inner peripheral wall and hence, it is possible to easily form the seal positioning ring by molding.

According to a fourth aspect and feature of the present invention, in addition to the first feature, the valve housing is comprised of a cylindrical valve housing body in which a movable core is accommodated, and a valve seat member which is fitted to an inner peripheral surface of a front end of the valve housing body and which has the valve seat at a front end of the valve seat member, the fitting surface being formed on an outer periphery of the valve housing body, the sealing surface and the tapered surface being formed on an outer periphery of the valve seat member.

With the fourth aspect and feature, the fitting surface, the sealing surface having a larger diameter than that of the fitting surface, and the tapered surface disposed between the fitting surface and the sealing surface, can be formed easily and accurately without grooving.

According to a fifth aspect and feature of the present invention, in addition to the first feature, the step is formed by a front end of a covering member made of a synthetic resin and coupled to the outer peripheral surface of the valve housing to cover a coil surrounding the valve housing.

With the fifth feature, the step, against which the seal positioning ring is put into abutment, can be formed without formation of a special flange or step on the valve housing by utilizing the covering member covering the coil, thereby simplifying the structure and providing a reduction in manufacture cost.

The above and other objects, features and advantages of the invention will become apparent from the following description of the preferred embodiments taken in conjunction with the accompanying drawings.

BRIEF DESCRIPTION OF THE DRAWINGS

FIGS. 1 to 4 show a first embodiment of the present invention, wherein

FIG. 1 is a vertical sectional side view of an essential portion of an engine in which an electromagnetic fuel injection valve including a seal member mounting structure according to the present invention;

FIG. 2 is a vertical sectional side view of the electromagnetic fuel injection valve;

FIG. 3 is an enlarged sectional view of an essential portion shown in FIG. 2;

FIG. 4 is an exploded view of an essential portion shown in FIG. 3;

DESCRIPTION OF THE PREFERRED EMBODIMENTS

The present invention will now be described by way of embodiments with reference to the accompanying drawings.

First, a first embodiment of the present invention shown in FIGS. 1 to 4 will be described.

Figure 1:
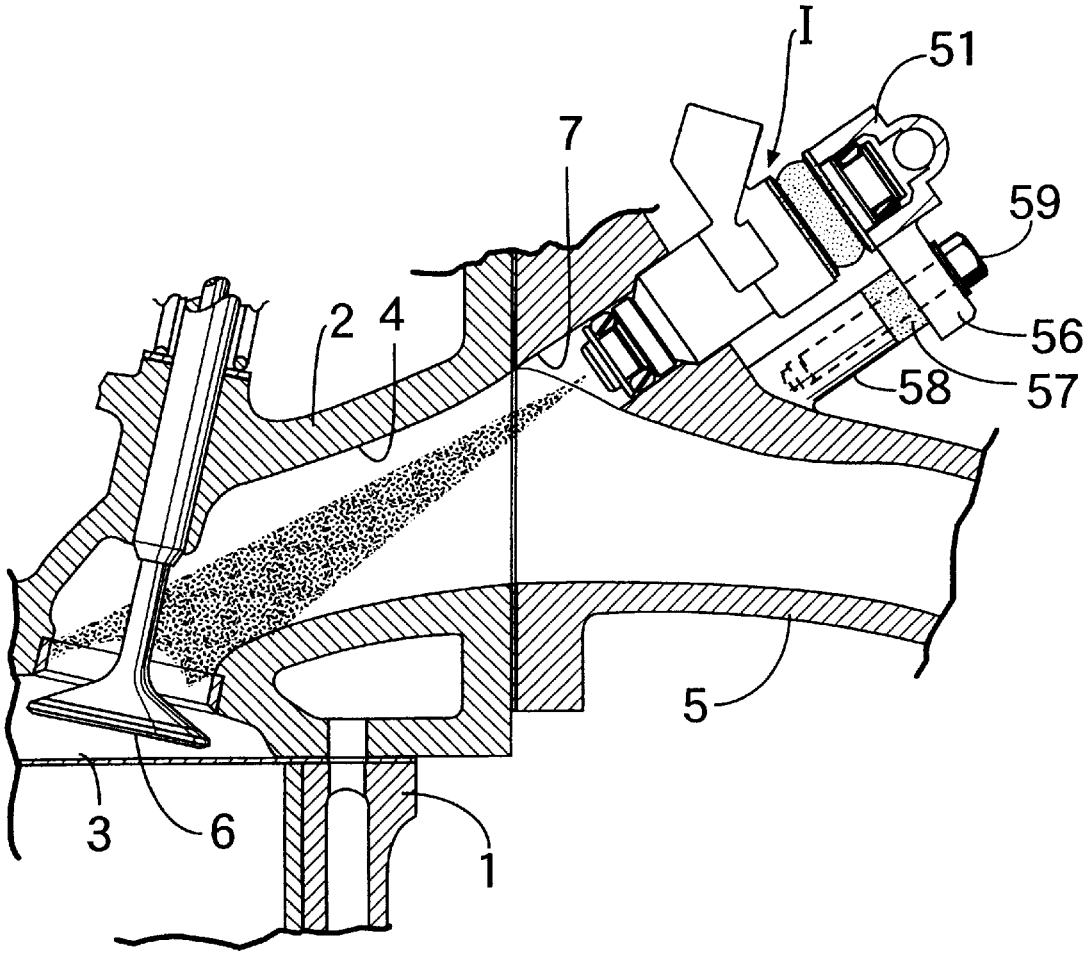

Referring to FIG. 1, reference character 1 designates a cylinder block of an engine. A combustion chamber 3 and an intake port 4 loading to the combustion chamber 3 are defined in a cylinder head 2 coupled to the cylinder block 1. The intake port 4 is opened and closed by an intake valve 6 driven by a valve operating device which is not shown.

An intake manifold 5 connected to the intake port 4 is coupled to opposite side surfaces of the cylinder head 2, and an electromagnetic fuel injection valve 1 having a seal member mounting structure according to the present invention is mounted in a mounting bore 7 in the intake manifold 5.

Figure 2:
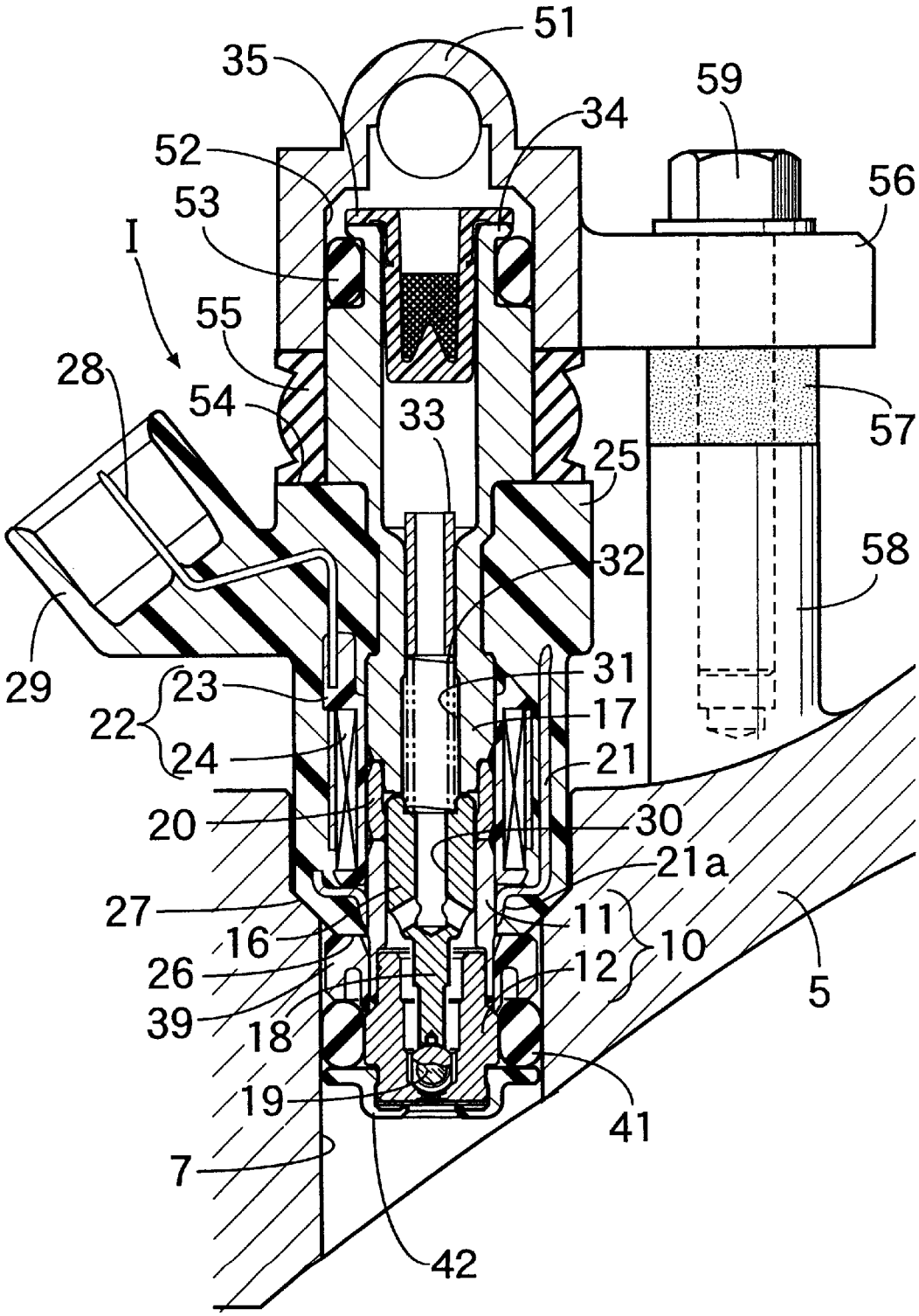

As shown in FIG. 2, the electromagnetic fuel injection valve 1 includes a housing 10 which is comprised of a cylindrical valve housing body 11 (made of a magnetic material), and a bottomed cylindrical valve seat member 12 which is fitted and welded to an inner peripheral surface of a front end portion of the valve housing body 11. The valve seat member 12 includes a valve bore 13 which opens into a front end surface of the valve seat member 12, and a conical valve seat 12*a* connected to a rear edge of the valve bore 13. An injection plate 15 made of a steel is welded over its entire periphery to the front end face of the valve seat member 12, and has a plurality of (e.g., a pair of in the illustrated embodiment) fuel injection bores 14 communicating with the valve bore 13.

A movable core 16 is accommodated in the valve housing body 11, and a spherical valve member 19 capable of seating on the valve seat 12*a* is welded to a valve stem 18 which is integrally and projectingly provided at a front end of the movable core 16. A sliding-movement guide tube 20 (made of a non-magnetic material) is welded over its entire periphery to a rear end surface of the valve housing body 11, and the movable core 16 is slidably supported by an inner peripheral surface of the sliding-movement guide tube 20.

A stationary core 17 is fitted and welded over its entire periphery to an inner peripheral surface of a rear end of the sliding-movement guide tube 20, and the movable core 16 is opposed to a front end face of the stationary core 17 with a clearance corresponding to a valve opening stroke of the valve member 19 being left therebetween.

A smaller-diameter portion 21*a* of a stepped cylindrical coil housing 21 (made of a magnetic material) is fitted and welded to an outer peripheral surface of a rear end of the valve housing body 11. A coil assembly 22 is accommodated in the coil housing 21 to surround the rear end of the valve housing 10, the sliding-movement guide tube 20 and the movable core 16. The coil assembly 22 comprises a bobbin 23 and a coil 24 wound around the bobbin 23. The coil housing 21, the coil assembly 22 and the stationary core 17 are embedded in a covering member 25 made of a synthetic resin. Formed at a front end of the covering member 25 are a step 26 rising radially from an outer periphery of the valve housing body 11, and a tapered stopper face 27 which is increased in diameter rearwards from an outer peripheral edge of the step 26. A coupler 29 having a connecting terminal 28 connected to the coil 24 is integrally connected to an intermediate portion of the covering member 25.

The stationary core 17 has a hollow 31 communicating with the inside of the valve housing 10 through a throughbore 30 in the movable core 16. Accommodated in the hollow 31 are a coiled valve spring 32 for biasing the movable core 16 in a direction to seat on the valve seat 12*a*, and a pipe-shaped retainer 33 which supports a rear end of the valve spring 32. The retainer 33 is press-fitted into the hollow 31 along an inner peripheral surface of the hollow 31, so that the preset load of the valve spring 32 is regulated by regulating the depth of press-fitting of the retainer 33 in the hollow 31. Further, an inlet tube 34 is integrally connected to the rear end of the stationary core 17 to communicate with the hollow 31 in the stationary core 17 through the pipe-shaped retainer 33, and a fuel filter 35 is mounted in the inlet tube 34.

Figure 3:
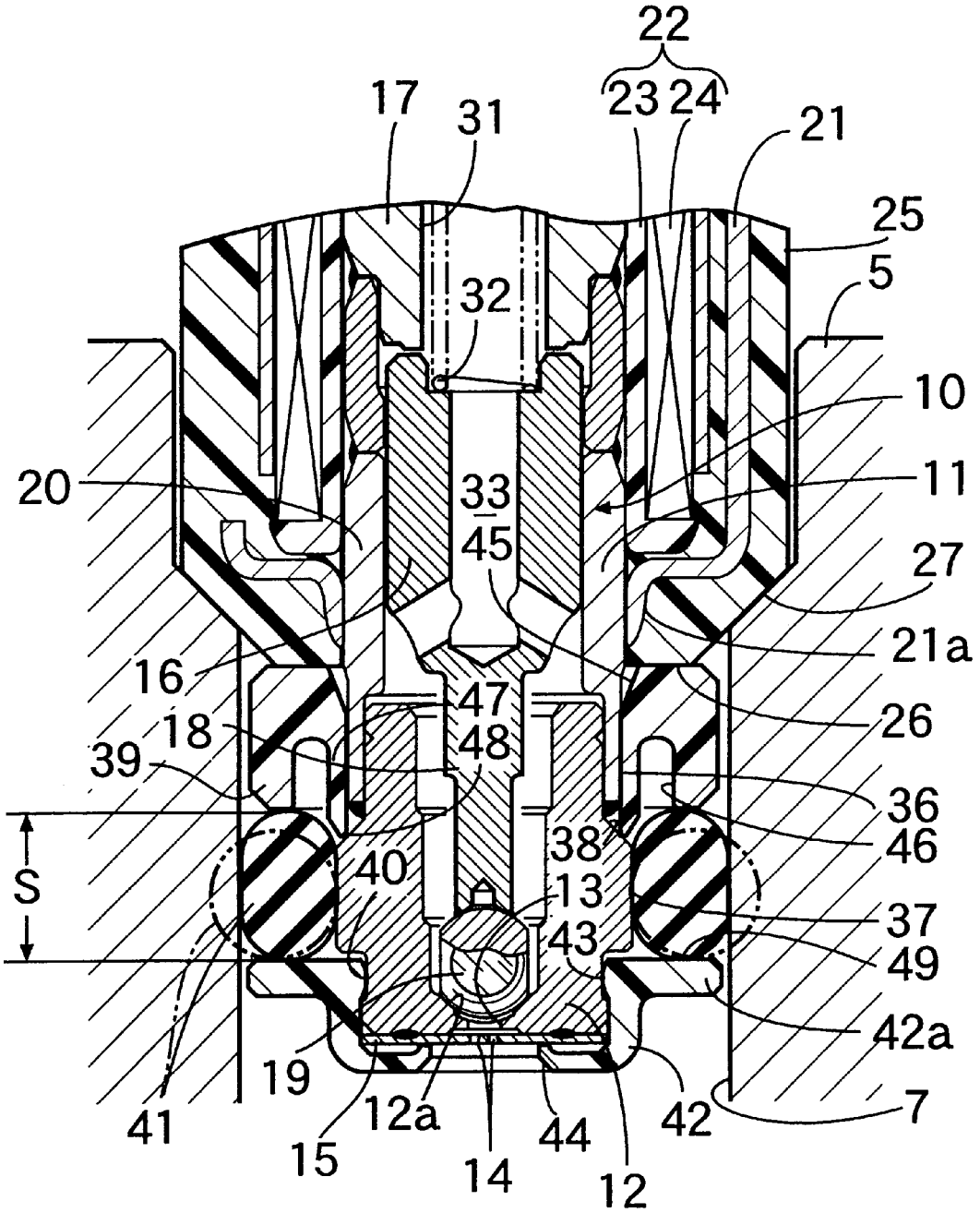
Figure 4:
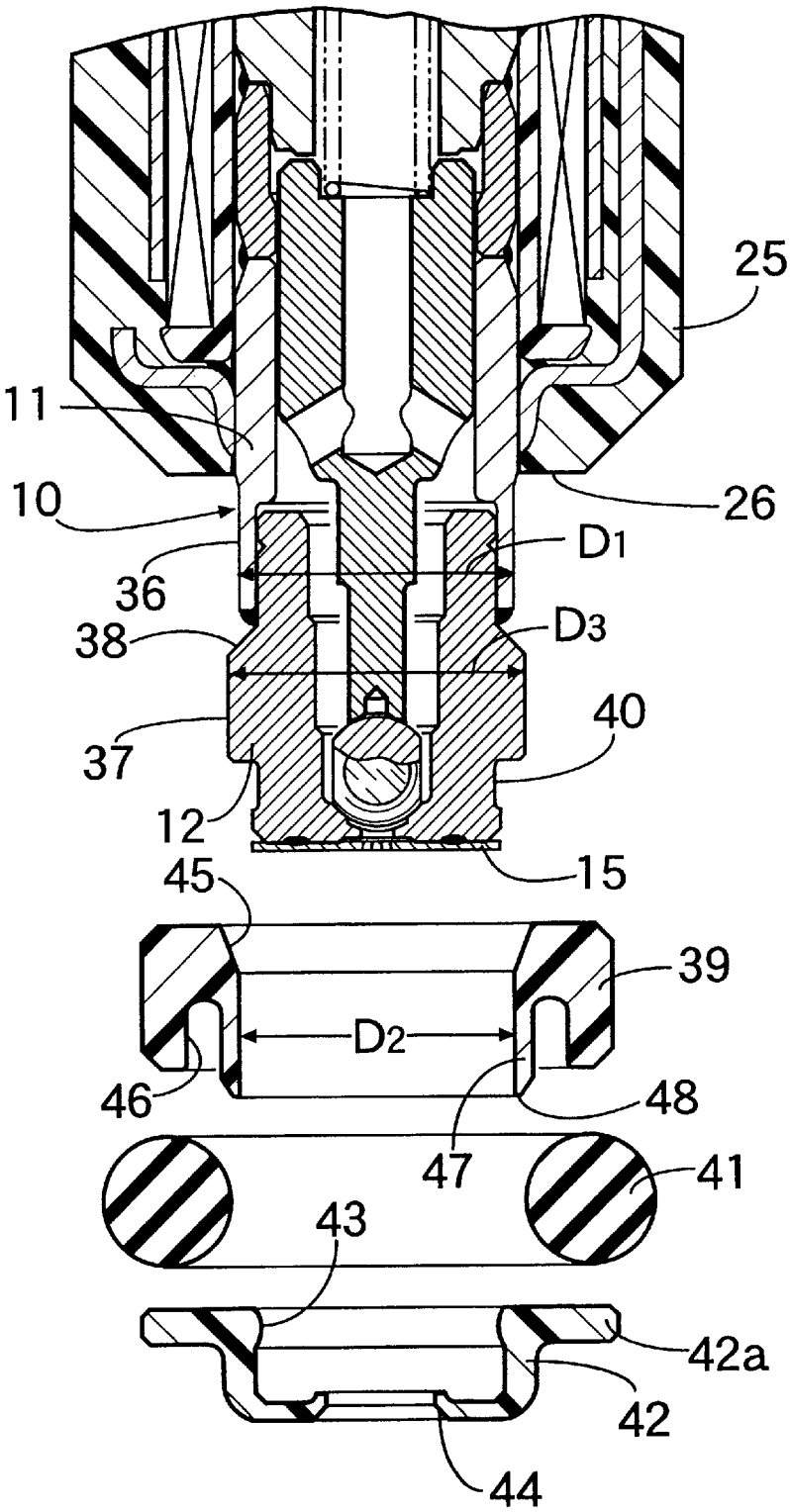

As shown in FIGS. 3 and 4, a fitting surface 36 having a diameter $D_1$ is formed at that portion of the outer periphery of the valve housing body 11, which is exposed forwards from the step 26 of the covering member 25, and a seal positioning ring 39 is fitted over the fitting surface 36 to abut against the step 26.

The outer periphery of the valve seat member 12 is provided with an annular sealing surface 37, a tapered surface 38 which is decreased in diameter from a rear edge of the sealing surface 37 toward the fitting surface 36, and an annular retaining groove 40 adjoining a front edge of the sealing surface 37. In this case, the sealing surface 37 has a diameter $D_3$ set larger than the diameter $D_1$ of the fitting surface 36. An O-ring 41 as a seal member is fitted over the sealing surface 37, and a locking projection 43 of a cap 42 made of a synthetic resin and fitted over the front end of the valve seat member 12 is resiliently engaged into the retaining groove 40. The cap 42 has a flange 42*a* protruding on an outer periphery of its rear end for inhibiting the separation of the O-ring 41 from the sealing surface 37, and also has an opening 44 at its front surface, so that the injection of fuel from the fuel injection bore 14 is not impeded.

The seal positioning ring 39 and the flange 42*a* define an annular seal mounting groove 49 having a bottom surface formed by the sealing surface 37.

The seal positioning ring 39 is made of a synthetic resin and has a diameter $D_2$ set smaller than the diameter $D_3$ of the sealing surface 37 and larger than the diameter $D_1$ of the fitting surface 36. Therefore, the fitting of the seal positioning ring 39 over the fitting surface 36 is performed past a state in which the seal positioning ring 39 has been forced onto the sealing surface 37, and a tapered guide surface 45 for guiding the forcing of the seal positioning ring 39 onto the sealing surface 37 is formed on an inner periphery of a rear end of the seal positioning ring 39. The seal positioning ring 39 is provided with a lightening annular recess 46 which opens into a front end surface thereof. An annular resilient projection 48 is integrally connected to a front end of an inner peripheral wall 47 surrounded by the lightening recess 46, and is brought into pressure contact with the tapered surface 38 of the valve seat member 12.

Referring again to FIGS. 1 and 2, a supply port 52 of a fuel distributing pipe 51 is fitted over an outer periphery of the inlet tube 34 of the electromagnetic fuel injection valve I with a seal member 53 interposed therebetween. In this case, a resilient member 55 for urging the stopper surface 27 into abutment against the intake manifold 5 is interposed between the fuel distributing pipe 51 and the intermediate step 54 of the covering member 25. The fuel distributing pipe 51 has, on one side thereof, a mounting boss 56 which is secured to a support boss 58 on an outer surface of the intake manifold 5 by a bolt 59 with an insulator collar 57 interposed therebetween. In this manner, the state of the O-ring 41 in close contact with the inner peripheral surface of the mounting bore 7 is maintained.

The operation of the first embodiment will be described below.

As shown in FIG. 4, the seal positioning ring 39, the O-ring 41 and the cap 42 are mounted in the named order on the valve housing 10. Particularly, in the mounting of the seal positioning ring 39, the tapered guide surface 45 is fitted precedently over the sealing surface 37, and hence, the forcing of the seal positioning ring 39 onto the sealing surface 37 can be conducted smoothly. When the seal positioning ring 39 is further fitted past the forced-on state, it reaches a state in which it has been fitted over the fitting surface 36. At this time, the resilient projection 48 is brought into pressure contact with the tapered surface 38, and the seal positioning ring 39 is reliably retained in a predetermined position in which it is in abutment against the step 26 of the covering member 25 by a reaction force generated by the resilient projection 48 with such pressure contact. Therefore, when the cap 42 is finally mounted at the tip end of the valve seat member 12, the width S of the seal mounting groove 49 defined by the flange 42*a* of the cap 42 and the seal positioning ring 39 to accommodate the O-ring 41 can be kept correctly constant at all times.

In this manner, the seal positioning ring 39, the O-ring 41 and the cap 42 all mounted on the valve housing 10 are fitted in the mounting bore 7 in the intake manifold 5. At this time, the O-ring 41 is urged to the inner peripheral surface of the mounting bore 7 to come into close contact with the various surfaces facing the seal mounting groove 49, i.e., the sealing surface 37, the opposed surfaces of the seal positioning ring and the flange 42*a* and the inner peripheral surface of the mounting bore 7, while being deformed from a circular shape in section to an elliptic shape in section. Particularly, because the width S of the seal mounting groove 49 is kept correctly constant, as described above, the amount of O-ring 41 deformed is constant. Therefore, the force of pressure contact of the O-ring 41 with the various surfaces is also constant at all times, and the sealing between the mounting bore 7 and the valve housing 10 can be reliably achieved at all times.

The lightening annular recess 46 of the seal positioning ring 39 not only contributes to a reduction in weight of the seal positioning ring 39, but also serves to properly regulate the resiliency of the inner peripheral wall 47. Even if the margin to force the seal positioning ring 39 onto the sealing surface 37 is set at a relatively large level, it is possible to easily achieve the passing of the seal positioning ring 39 through the state in which the seal positioning ring 39 has been forced onto the sealing surface 37, thereby reliably providing a state in which the resilient projection 48 is in pressure contact with the tapered surface 38.

Moreover, the shape of the seal positioning ring 39 is simplified by the integral formation of the inner peripheral wall 47 and the resilient projection 48, and hence, it is possible to easily form the seal positioning ring 39.

The valve housing 10 is divided into the cylindrical valve housing body 11 and the bottomed cylindrical valve seat member 12 fitted and welded to the front end of the valve housing body 11. The fitting surface 36 is formed on the valve housing body 11, and the sealing surface 37 having the diameter larger than that of the fitting surface 36 and the tapered surface 38 are formed on the valve seat member 12. Therefore, the surfaces 36, 37 and 38 can be formed easily and accurately without grooving.

Referring to FIGS. 1 and 2, when the coil 24 is in a deenergized, the movable core 16 and the valve member 19 are urged forwards by the biasing force of the valve spring 32, whereby the valve member 19 is seated onto the valve seat 12*a*. Therefore, high-pressure fuel supplied from the fuel distributing pipe 51 through the fuel filter 35 and the inlet tube 34 into the valve housing 1 is retained within the valve housing 1.

When the coil 24 is energized, a magnetic field generated by such energization runs sequentially through the stationary core 17, the movable core 16, the valve housing 10 and the coil housing 21, whereby the movable core 16 is attracted to the stationary core with the valve member 19 to open the valve seat 12*a*. Therefore, high-pressure fuel in the valve housing 10 is injected from the fuel injection bore 14 toward the intake valve 6.

Figure 5:
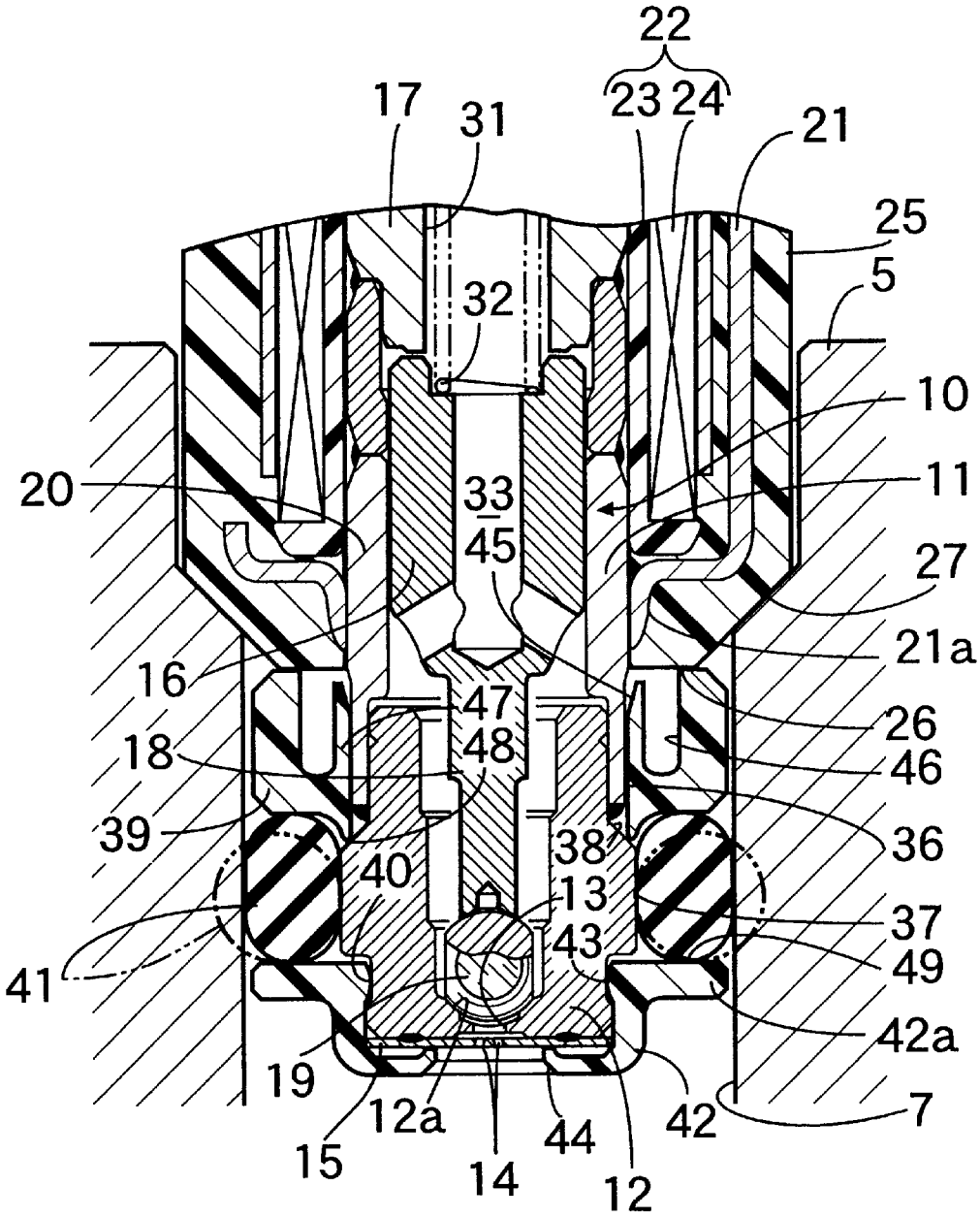
FIG. 5 is a sectional view similar to FIG. 3, but according to a second embodiment of the present invention.

A second embodiment of the present invention will now be described with reference to FIG. 5.

In the second embodiment, a seal positioning ring 39 fitted over the fitting surface 36 of the valve housing body 11 is disposed with an open surface of a lightening recess 46 turned rearwards, and a resilient projection 48 is integrally formed on the front surface opposite to the open surface to come into pressure contact with the tapered surface 38 of the valve seat member 12. The other arrangement is similar to that in the previous embodiment and hence, portions or components corresponding to those in the previous embodiment are designated by like reference characters, and the description of them is omitted.

Although the embodiments of the present invention have been described in detail, it will be understood that the present invention is not limited to the above-described embodiments, and various modifications may be made without departing from the spirit and scope of the invention defined in claims.

What is claimed is:

1. A seal member mounting structure in an electromagnetic fuel injection valve, comprising a step which is formed on an outer periphery of a valve housing having a valve seat at its front end and which faces a front end of said valve housing, a seal positioning ring made of a synthetic resin, which is mounted on the outer periphery of said valve housing to abut against said step, a cap which is fitted over and locked to an outer periphery of the front end of said valve housing to define an annular seal mounting groove on an outer peripheral surface of said valve housing by cooperation with said seal positioning ring, and an annular seal member which is mounted in said seal mounting groove to come into close contact with an inner peripheral surface of a mounting bore provided in an intake manifold of an engine, wherein said valve housing has a fitting surface over which said seal positioning ring is fitted, said fitting surface being formed of a diameter smaller than that of an annular sealing surface which serves as a bottom surface of said seal mounting groove, and a tapered surface which is connected to a rear edge of said sealing surface and which is decreased in diameter toward said fitting surface, and said seal positioning ring is formed so that the ring is fitted over said fitting surface past a state in which it has been forced onto said sealing surface, said seal positioning ring having a resilient projection formed thereon, said resilient projection being placed in pressure contact with said tapered surface in a state in which said seal positioning ring has been fitted over said fitting surface.

2. A seal member mounting structure in an electromagnetic fuel injection valve according to claim 1, wherein said seal positioning ring is provided with an annular lightening recess which opens at one end surface thereof.

3. A seal member mounting structure in an electromagnetic fuel injection valve according to claim 2, wherein said resilient projection is formed integrally at a front end of an inner peripheral wall of said seal positioning ring, which is surrounded by said lightening recess.

4. A seal member mounting structure in an electromagnetic fuel injection valve according to claim 1, wherein said valve housing comprises a cylindrical valve housing body in which a movable core is accommodated, and a valve seat member which is fitted to an inner peripheral surface of a front end of said valve housing body and which has said valve seat at a front end of the valve seat member, said fitting surface being formed on an outer periphery of said valve housing body, said sealing surface and said tapered surface being formed on an outer periphery of said valve seat member.

5. A seal member mounting structure in an electromagnetic fuel injection valve according to claim 1, wherein said step is formed by a front end of a covering member made of a synthetic resin and coupled to the outer peripheral surface of said valve housing to cover a coil surrounding said valve housing.

* * * * *